US008461521B2

(12) United States Patent
Vestal

(10) Patent No.: US 8,461,521 B2
(45) Date of Patent: Jun. 11, 2013

(54) LINEAR TIME-OF-FLIGHT MASS SPECTROMETRY WITH SIMULTANEOUS SPACE AND VELOCITY FOCUSING

(75) Inventor: Marvin L. Vestal, Framingham, MA (US)

(73) Assignee: Virgin Instruments Corporation, Sudbury, MA (US)

( * ) Notice: Subject to any disclaimer, the term of this patent is extended or adjusted under 35 U.S.C. 154(b) by 0 days.

(21) Appl. No.: 12/968,254

(22) Filed: Dec. 14, 2010

(65) Prior Publication Data

US 2012/0145893 A1 Jun. 14, 2012

(51) Int. Cl.
*H01J 49/40* (2006.01)

(52) U.S. Cl.
USPC ..... 250/287

(58) Field of Classification Search
USPC ..... 250/281–300
See application file for complete search history.

(56) References Cited

U.S. PATENT DOCUMENTS

| | | | | |
|---|---|---|---|---|
| 5,087,815 | A | 2/1992 | Schultz et al. | |
| 5,144,127 | A | 9/1992 | Williams et al. | |
| 5,160,840 | A | 11/1992 | Vestal | |
| 5,166,518 | A | 11/1992 | Freedman | |
| 5,625,184 | A | 4/1997 | Vestal et al. | |
| 5,627,369 | A | 5/1997 | Vestal et al. | |
| 5,847,385 | A | 12/1998 | Dresch | |
| 6,057,543 | A | 5/2000 | Vestal et al. | |
| 6,300,627 | B1 | 10/2001 | Koster et al. | |
| 6,489,610 | B1 | 12/2002 | Barofsky et al. | |
| 6,512,225 | B2 * | 1/2003 | Vestal et al. | 250/287 |
| 6,534,764 | B1 | 3/2003 | Verentchikov et al. | |
| 6,621,074 | B1 | 9/2003 | Vestal | |
| 6,872,941 | B1 | 3/2005 | Whitehouse et al. | |
| 7,176,454 | B2 * | 2/2007 | Hayden et al. | 250/288 |
| 7,214,320 | B1 | 5/2007 | Gregori et al. | |

(Continued)

FOREIGN PATENT DOCUMENTS

WO 2006-064280 A2 6/2006

OTHER PUBLICATIONS

"Notification Concerning Transmittal of International Preliminary Report on Patentability (Chapter I of the Patent Cooperation Treaty" for PCT/US2010/048074, Mar. 8, 2012, 5 pages, The International Bureau of WIPO, Geneva, Switzerland.

(Continued)

*Primary Examiner* — Jack Berman
*Assistant Examiner* — Eliza Osenbaugh-Stewart
(74) *Attorney, Agent, or Firm* — Kurt Rauschenbach; Rauschenbach Patent Law Group, LLC

(57) ABSTRACT

A time-of-flight mass spectrometer includes an ion source that generates ions. A two-field ion accelerator receives the ions generated by the ion source and generates an electric field that accelerates the ions through an ion flight path. A pulsed ion accelerator generates an accelerating electric field that focuses the ions to a focal plane where the ion flight time to the focal plane for an ion of predetermined mass-to-charge ratio is substantially independent to first order of an initial velocity of the ions prior to acceleration. An ion detector is positioned at the focal plane to detect ions. The two-field ion accelerator generates electric fields that cause the ion flight time to the ion detector for an ion of predetermined mass-to-charge ratio to be substantially independent to first order of both the initial position and the initial velocity of the ions prior to acceleration.

20 Claims, 8 Drawing Sheets

U.S. PATENT DOCUMENTS

| | | | | |
|---|---|---|---|---|
| 7,223,966 | B2 | 5/2007 | Weiss et al. | |
| 7,355,169 | B2 | 4/2008 | McLuckey et al. | |
| 7,564,026 | B2 | 7/2009 | Vestal | |
| 7,564,028 | B2 | 7/2009 | Vestal | |
| 7,589,319 | B2 | 9/2009 | Vestal | |
| 7,663,100 | B2 | 2/2010 | Vestal | |
| 7,667,195 | B2 | 2/2010 | Vestal | |
| 2002/0158194 | A1 | 10/2002 | Vestal et al. | |
| 2003/0141447 | A1 | 7/2003 | Verentchikov et al. | |
| 2005/0116162 | A1 * | 6/2005 | Vestal | 250/287 |
| 2005/0269505 | A1 | 12/2005 | Ermer | |
| 2005/0279933 | A1 | 12/2005 | Appelhans et al. | |
| 2008/0272291 | A1 * | 11/2008 | Vestal | 250/287 |
| 2009/0294658 | A1 | 12/2009 | Vestal et al. | |
| 2010/0181473 | A1 * | 7/2010 | Blenkinsopp et al. | 250/282 |
| 2010/0301202 | A1 | 12/2010 | Vestal | |
| 2011/0049346 | A1 * | 3/2011 | Wells | 250/282 |

OTHER PUBLICATIONS

"Notification of Transmittal of the International Search Report and the Written Opinion of the International Searching Authority, or the Declaration" for PCT/US2010/022122, Aug. 16, 2010, 9 pages, International Searching Authority, Korean Intellectual Property Office, Seo-gu, Daejeon, Republic of Korea.

Beavis, Ronald C., et al., Factors Affecting the Ultraviolet Laser Desorption of Properties, Rapid Communications in Mass Spectrometry, 1989, pp. 233-237, vol. 3 No. 9, Heyden & Son Limited.

Bergmann, T., et al., High-Resolution Time-Of-Flight Mass Spectrometer, Rev. Sci. Instrum., Apr. 1989, pp. 792-793, vol. 60, No. 4, American Institute of Physics.

Beussman, Douglas J., et al., Tandem Reflectron Time-Of-Flight Mass Spectrometer Utilizing Photodissociation, Analytical Chemistry, Nov. 1, 1995, pp. 3952-3957, vol. 67, No. 21, American Chemical Society.

Colby, Steven M., et al., Space-Velocity Correlation Focusing, Analytical Chemistry, Apr. 15, 1996, pp. 1419-1428, vol. 68, No. 8, American Chemical Society.

Cornish, Timothy J., et al., A Curved Field Reflectron Time-Of-Flight Mass Spectrometer for the Simultaneous Focusing of Metastable Product Ions, Rapid Communication in Mass Spectrometry, 1994 pp. 781-785, vol. 8, John Wiley & Sons.

Cornish, Timothy J., et al., Tandem Time-Of-Flight Mass Spectrometer, Analytical Chemistry, Apr. 15, 1993, pp. 1043-1047, vol. 65, No. 8.

Hillenkamp, F., Laser Desorption Mass Spectrometry: Mechanisms, Techniques and Applications, 1989, pp. 354-362, vol. 11A, Heyden & Son, London.

Kaufmann, R., et al., Mass Spectrometric Sequencing of Linear Peptides by Product-Ion Analysis in a Reflectron Time-Of-Flight Mass Spectrometer Using Matrix Assisted Laser Desorption Ionization, Rapid Communications in Mass Spectrometry, 1993, pp. 902-910, vol. 7, John Wiley & Sons, Ltd.

Mamyrin, B.A. et al., The Mass-Reflectron, A New Nonmagnetic Time-Of-Flight Mass Spectrometer With High Resolution, Sov. Phys. 1973, pp. 45-48, vol., 37, No. 1, American Institute of Physics.

Matsuda, H., et al., Particle Flight Times Through Electrostatic and Magnetic Sector Fields and Quadrupoles to Second Order, International Journal of Mass Spectrometry and Ion Physics, 1982, pp. 157-168, vol. 42, Elsevier Scientific Publishing Company, Amsterdam, The Netherlands.

Neuser, H. J., et al., High-Resolution Laser Mass Spectrometry, International Journal of Mass Spectrometry and Ion Process, 1984, pp. 147-156, vol. 60, Elsevier Science Publishers B.V., Amsterdam, The Netherlands.

Vestal, M. L., et al., Delayed Extraction Matrix-Assisted Laser Desorption Time-Of-Flight Mass Spectrometry, Rapid Communications in Mass Spectrometry, 1995, pp. 1044-1050, vol. 9, John Wiley & Sons, Ltd.

Vestal, M. L., et al., Resolution and Mass Accuracy in Matrix Accuracy in Matrix-Assisted Laser Desorption Ionization-Time-Of-Flight, American Society for Mass Spectrometry, 1998, pp. 892-911, Elsevier Science, Inc.

Vestal, M., High Performance MALDI-TOF Mass Spectrometry for Proteomics, International Journal of Mass Spectrometry, 2007, pp. 83-92.

Wiley, W. C., et al., Time-Of-Flight Mass Spectrometer With Improved Resolution, The Review of Scientific Instruments, Dec. 1955, pp. 1150-1157, vol. 26, No. 13.

Zhou, J. Kinetic Energy Measurements of Molecular Ions Ejected Into an Electric Field by Matrix-Assisted Laser Desorption, Rapid Communications in Mass Spectrometry, Sep. 1992, pp. 671-678, vol. 6, John Wiley & Sons, Ltd.

Vestal, M., Quantitative Measurement of Isotope Ratios by Time-Of-Flight Mass Spectrometry, U.S. Appl. No. 12/365,354, filed Feb. 4, 2009.

Vestal, M., Tandem TOF Mass Spectrometer With High Resolution Precursor Selection and Multiplexed MS-MS, U.S. Appl. No. 12/475,432, filed May 29, 2009.

Vestal, M., Tandem TOF Mass Spectrometer With Pulsed Accelerator to Reduce Velocity Spread, U.S. Appl. No. 12/549,076, filed Aug. 27, 2009.

"Notification Concerning Transmittal of International Preliminary Report on Patentability (Chapter I of the Patent Cooperation Treaty)" for PCT/US2009/045108, Dec. 9, 2010, 9 pages, The International Bureau of WIPO, Geneva, Switzerland.

"Notification Concerning Transmittal of International Preliminary Report on Patentability (Chapter I of the Patent Cooperation Treaty" for PCT/US2010/060902, Jul. 12, 2012, 7 pages, The International Bureau of WIPO, Geneva, Switzerland.

"Notification of Transmittal of the International Search Report and the Written Opinion of the International Searching Authority, or the Declaration" for PCT/US2012/025761, Sep. 25, 2012, 9 pages, International Searching Authority/KR, Daejeon Metropolitan City, Republic of Korea.

"Office Action" for U.S. Appl. No. 12/651,070, Dec. 9, 2011, 31 pages, United States Patent Office, Alexandria, VA, US.

"Office Action" for U.S. Appl. No. 12/651,070, May 24, 2011, 50 pages, United States Patent Office, Alexandria, VA, US.

"Notification of Transmittal of the International Search Report and the Written Opinion of the International Searching Authority, or the Declaration" for PCT/US2011/063855, Jul. 27, 2012, 11 pgs., International Searching Authority/Korea, Korean Intellectual Property Office, Daejeon Metropolitan City, Republic of Korea.

* cited by examiner

LINEAR TIME-OF-FLIGHT MASS SPECTROMETRY WITH SIMULTANEOUS SPACE AND VELOCITY FOCUSING

FEDERAL RESEARCH STATEMENT

This invention was made with Government support under SBIR Grant Number 1R44RR025705 awarded by the National Institutes of Health. The Government has certain rights in this invention.

The section headings used herein are for organizational purposes only and should not to be construed as limiting the subject matter described in the present application in any way.

INTRODUCTION

The first practical time-of-flight (TOF) mass spectrometer was described by Wiley and McClaren more than 50 years ago. TOF mass spectrometers were generally considered to be only a tool for exotic studies of ion properties for many years. See, for example, "Time-of-Flight Mass Spectrometry: Instrumentation and Applications in Biological Research," Cotter R J., American Chemical Society, Washington, D.C. 1997, for review of the history, development, and applications of TOF-MS in biological research.

Early TOF mass spectrometer systems included ion sources with electron ionization in the gas phase where a beam of electrons is directed into the ion source. The ions produced have a distribution of initial positions and initial velocities that are determined by the intersection of the electron beam with the neutral molecules present in the ion source. The initial position of the ions and their corresponding initial velocities are independent variables that affect the flight time of the ions in a TOF-MS. Wiley and McLaren developed and demonstrated methods for minimizing the contribution of the initial position and the initial velocity distributions. Techniques for minimizing the contribution of initial position are called "space focusing" techniques. Techniques for minimizing the contribution of initial velocity are called "time lag focusing" techniques. One important conclusion made by Wiley and McLaren is that it is impossible to simultaneously achieve both space focusing and velocity focusing. Optimization of these TOF mass spectrometers required finding the optimum compromise between the space focusing and the velocity focusing distributions.

The advent of naturally pulsed ion sources such as CF plasma desorption ions source, static secondary ion mass spectrometry (SIMS), and matrix-assisted laser desorption/ionization (MALDI) ion sources has led to renewed interest in TOF mass spectrometers. Recent work in TOF mass spectrometry has focused on developing new and improved TOF instruments and software that take advantage of MALDI and electrospray (ESI) ionization sources that have removed the volatility barrier for mass spectrometry and that have facilitated applications of important biological applications.

The ion focusing techniques used with MALDI and electrospray (ESI) ion sources reflect the practical limits on the position and velocity distributions that can be achieved with these techniques. Achieving optimum performance with electrospray ionization and MALDI ionization methods requires finding the best compromise between space and velocity focusing. Electrospray ionization methods have been developed to improve space focusing. Electrospray ionization forms a beam of ions with a relatively broad distribution of initial positions and a very narrow distribution in velocity in the direction that ions are accelerated.

In contrast, MALDI ionization methods have been developed to improve velocity focusing. MALDI ionization methods use samples deposited in matrix crystals on a solid surface. The variation in the initial ion position is approximately equal to the size of the crystals. The velocity distribution is relatively broad because the ions are energetically ejected from the surface by the incident laser irradiation.

BRIEF DESCRIPTION OF THE DRAWINGS

The present teachings, in accordance with preferred and exemplary embodiments, together with further advantages thereof, is more particularly described in the following detailed description, taken in conjunction with the accompanying drawings. The skilled person in the art will understand that the drawings, described below, are for illustration purposes only. The drawings are not necessarily to scale, emphasis instead generally being placed upon illustrating principles of the invention. The drawings are not intended to limit the scope of the Applicant's teachings in any way.

Definitions

Figure 1:
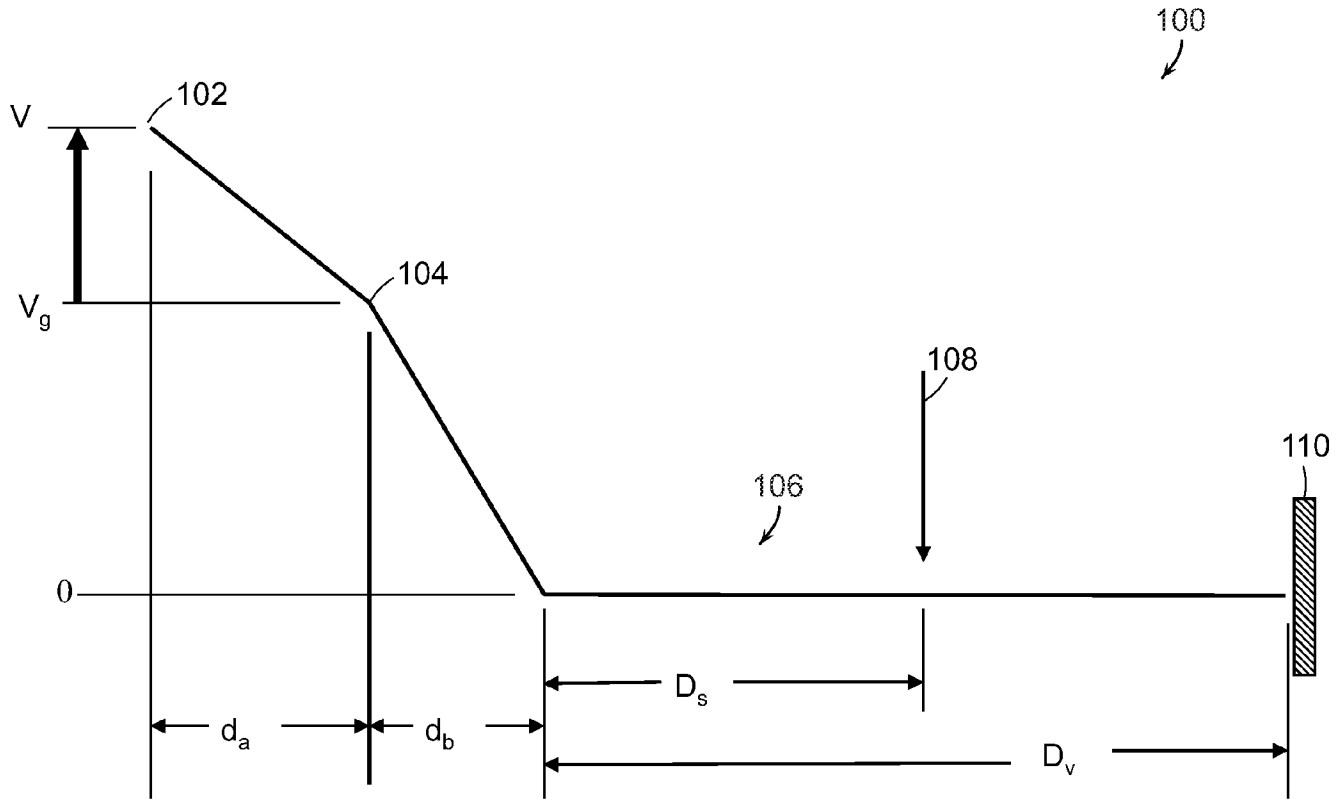
FIG. 1 PRIOR ART
FIG. 1 illustrates a potential diagram for a known linear TOF mass spectrometer comprising a pulsed two-field ion accelerator, a drift tube, and an ion detector.

The following variables are used in the Description of Various Embodiments:

D=Distance in the field-free region;

$D_v$=Distance to the first order velocity focus point;

$D_s$=Distance to the first order spatial focus point;

$D_e$=Effective length of the equivalent field-free region;

$D_{es}$=Effective length of the two-field accelerating field;

$D_a$=Distance from the end of the static field to the center of the pulsed accelerating field;

$d_a$=Length of the first accelerating field;

$d_b$=Length of the second accelerating field;

$d_1$=Length of the pulsed acceleration region;

$\delta_x$=Spread in initial position of the ions;

$\Delta t$=Time lag between the ion production and the application of the accelerating field;

p=Total effective perturbation accounting for all of the initial conditions;

$p_1$=perturbation due to the initial velocity distribution;

$p_2$=perturbation due to the initial spatial distribution;

V=Total acceleration potential;

$V_g$=Voltage applied to the extraction grid;
$v_n$=Nominal final velocity of the ion after acceleration;
$V_p$=the amplitude of the pulsed voltage;
y=Ratio of the total accelerating potential V to the accelerating potential difference in the first field;
$m_0$=Mass of the ion focused to first order at the detector;
δt=Width of the peak at the detector; and
$\delta v_0$=Initial velocity spread of the ions.

DESCRIPTION OF VARIOUS EMBODIMENTS

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

It should be understood that the individual steps of the methods of the present teachings may be performed in any order and/or simultaneously as long as the invention remains operable. Furthermore, it should be understood that the apparatus and methods of the present teachings can include any number or all of the described embodiments as long as the invention remains operable.

The present teachings will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications and equivalents, as will be appreciated by those of skill in the art. Those of ordinary skill in the art having access to the teachings herein will recognize additional implementations, modifications, and embodiments, as well as other fields of use, which are within the scope of the present disclosure as described herein.

Known TOF mass spectrometers include ion sources with pulsed ion acceleration. The pulsed acceleration in the ion source provides first order velocity focusing for a single selected ion. However, the pulsed acceleration in the ion source cannot focus a broad range of masses. In addition, the pulsed acceleration in the ion source does not correct for variations in the ion's initial position.

FIG. 1 illustrates a potential diagram 100 for a known linear TOF mass spectrometer comprising a pulsed ion source with a two-field ion accelerator, a drift tube, and an ion detector. Pulsed and static electric fields are used to accelerate and focus the ions in both space and time. The potential diagram 100 shows the total accelerating potential V at the sample plate position 102 where the sample is ionized. The voltage $V_g$ is the potential applied to the extraction electrode positioned at electrode position 104 that is a distance $d_a$ from the sample plate position 102. The ions are accelerated through a first acceleration region that extends the distance $d_a$. The extraction electrode is biased at potential $V_g$. The ions are extracted by the extraction electrode through a distance $d_b$ in a second acceleration region to a field-free region 106. The ions travel a distance $D_s$ in the field-free region 106 to the spatial focus point 108. The ions travel a distance $D_v$ to the velocity focus point which is at the detector position 110 where the ions are detected by a detector.

The ideal pulsed ion source produces a narrow, nearly parallel beam with all ions of each m/z arriving at a detector with a flight time that is nearly independent of the initial position and the initial velocity of the ions. The general conditions for both space and time focusing were described by Wiley and McLaren. The flight time for the known linear TOF mass spectrometer having the potential diagram shown in FIG. 1 can be described with the following equation:

$$t=(D_e/v_n)\{(1-p/y)^{-1/2}+(2d_a y^{1/2}/D_e)[(1-p)^{1/2}-y^{1/2}v_0/v_n]\}$$

where $D_e$ is the effective length of an equivalent field-free region and can be expressed as $$D_e=D_{es}+D,$$

where $$D_{es}=2d_a y^{1/2}[1+(d_b/d_a)/(y^{1/2}+1)],$$

$D_{es}$ is the effective length of the accelerating region, D is the distance travelled in the field-free region, and $$p=x/d_a+v_0\Delta t/d_a-yv_0^2/v_n^2 \text{ where}$$

$$y=V/(V-V_g)$$

where $d_a$ is the length of the first acceleration region, d is the length of the second acceleration region and D is the field-free distance between the source exit and the detector. The time Δt is the time lag between the ion production and the application of the accelerating field. The voltage V is the total acceleration potential, the voltage $V_g$ is the voltage applied to the extraction grid, and $v_n$ is the nominal final velocity of the ion with mass-to-charge ratio m/z. The velocity $v_n$ in units of m/s is given by the following equation:

$$v_n=C_1(zV/m)^{1/2}$$

where the numerical constant $C_1$ is given by $$C_1=(2z_0/m_0)^{1/2}=[2\times1.60219\times10^{-19}\ coul/1.66056\times10^{-27}\ \text{kg}]^{1/2}=1.38914\times10^4.$$

and the voltage V is in units volts and the mass m is in units of Da.

The focal lengths for first order space and velocity focusing are given by $$D_s=2d_a y^{3/2}[1-(d_b/d_a)/(y^{1/2}+y)]$$

$$D_v=D_s+(2d_a y)^2/(v_n^*\Delta t)$$

where $v_n^*$ is the nominal final velocity of the ions of mass m* that are focused at the velocity focus point $D_v$ and is given by $$v_n^*=C_1(V/m^*)^{1/2}.$$

In known linear TOF mass spectrometers, the parameters are adjusted to place the velocity focus plane at the detector. For a given mass spectrometer geometry, the space focus $D_s$ can be adjusted by varying the voltage ratio $y=V/(V-V_g)$, and the difference between the space focus $D_s$ and the velocity focus $D_v$ can be independently adjusted by varying the time lag between the ion production and the application of the accelerating field Δt.

The contribution to the mass-to-charge ratio peak width (δm/m) due to the initial position δx is $$R_{s1}=2[(D_v-D_s)/2d_a y][\delta x/(D_{es}+D_v)].$$

The first order contributions to the mass-to-charge ratio peak width (δm/m) due to the initial velocity δv is $$R_{v1}=2[2d_a y/(D_{es}+D_v)][\delta v_0/v_n][1-(m_0/m)^{1/2}].$$

The second order contributions to the mass-to-charge ratio peak width (δm/m) due to the initial velocity δv is $$R_{v2}=2[2d_a y/(D_v-D_s)]^2[\delta v_0/v_n]^2.$$

Thus, if the difference between the space focus $D_s$ and the velocity focus $D_v$ is small, then the mass-to-charge ratio peak width is dominated by the second order velocity dependence and low resolving power over a broad mass range is achieved. On the other hand, as both the voltage ratio $y=V/(V-V_g)$ and the difference between the space focus $D_s$ and the velocity focus $D_v$ are made larger, relatively high resolving power is possible at the focus mass $m_0$. However, the mass range with high resolving power is very narrow due to the contribution from the first order dependence on the initial velocity.

In other words, first order velocity focusing can only be achieved for a selected mass using this technique. Known TOF mass spectrometers use delayed pulsed acceleration in the ion source to achieve first order velocity focusing for a single selected ion mass-to-charge ratio. Delayed pulsed acceleration was referred to as "time lag focusing" by Wiley and Mclaren and more recently is referred to as "delayed extraction" or "delayed pulsed extraction." Although time lag focusing provides first order velocity focusing for a selected mass, it is not suitable for focusing a broad range of masses as described above. Furthermore, time lag focusing does not correct for variations in the initial ion position.

The present teaching relates to mass spectrometer apparatus and methods that provide simultaneous space and velocity focusing for an ion of predetermined mass-to-charge ratio. In addition, the present teaching relates to mass spectrometers apparatus and methods that provide high mass resolution performance for a broad range of ions.

One aspect of the present teaching is that it has been discovered that pulsed acceleration in the ion source is not required to achieve velocity focusing. It has also been discovered that pulsed acceleration can be used for initiating time-of-flight measurements when a continuous beam of ions is generated. Furthermore, it has been discovered that higher mass resolution can be achieved by using pulsed acceleration for initiating TOF measurements.

Figure 2:
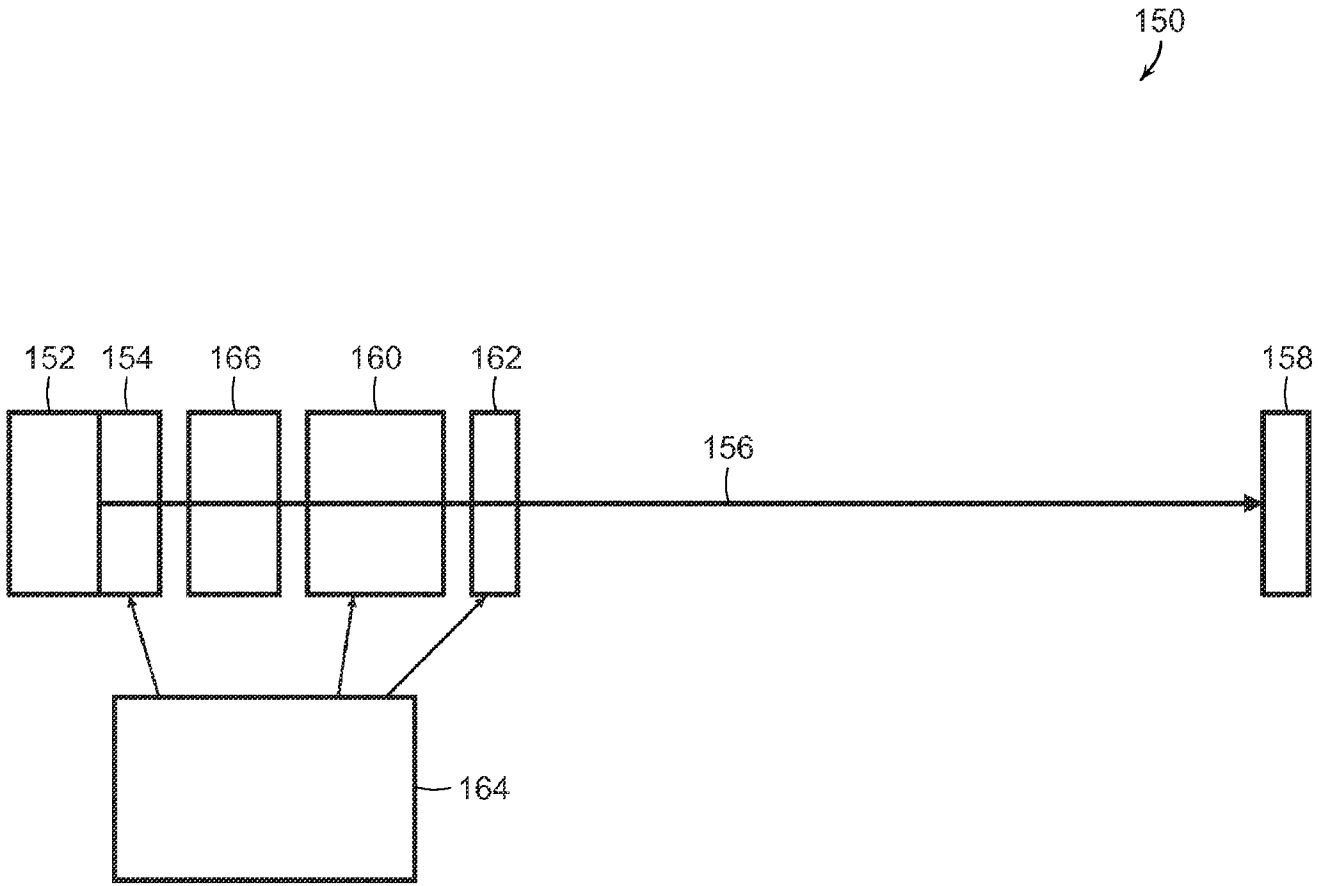
FIG. 2 shows a block diagram of a linear TOF mass spectrometer according to the present teaching.

FIG. 2 shows a block diagram of a linear TOF mass spectrometer 150 according to the present teaching that includes an ion source 152, a two-field ion accelerator 154, an ion flight path 156, and an ion detector 158. The ion flight path 156 can include at least one field-free region. A pulsed ion accelerator 160 is positioned in the ion flight path 156 between the two-field ion accelerator 154 and the ion detector 158. A timed ion selector 162 is positioned in the ion flight path 156 between the pulsed ion accelerator 160 and the ion detector 158. The ion detector 158 is positioned at the end of the ion flight path 156.

A voltage generator 164 supplies accelerating voltages to the two-field ion accelerator 154, to the pulsed ion accelerator 160, and to the timed ion selector 162. In various other embodiments, two or three separate voltage generators can be used. The voltages supplied by the voltage generator 164 to the two-field ion accelerator 154 and to the pulsed ion accelerator 160 accelerate and focus the ions to the ion detector 158 where the ion flight time for an ion of predetermined mass-to-charge ratio is independent to first order of both the initial position and the initial velocity of the ions prior to acceleration.

The timed ion selector 162 transmits ions accelerated by pulsed ion accelerator 160 to the ion detector 158 and prevents all other ions from reaching the ion detector 158. In some embodiments, ion focusing and steering elements 166 known in the art are positioned in the ion flight path 156 between the two-field ion accelerator 154 and the pulsed ion accelerator 160 to enhance the transmission of ions to the ion detector 158.

There are various modes of operating the linear TOF mass spectrometer 150 according to the present teaching. In one mode of operation according to the present teaching, the ion source 152 is a pulsed ion source and the two-field ion accelerator 154 generates a static electric field. In another mode of operation according to the present teaching, the ion source 152 is a continuous source of ions and the two-field ion accelerator 154 generates a pulsed electric field and a static electric field.

Figure 3:
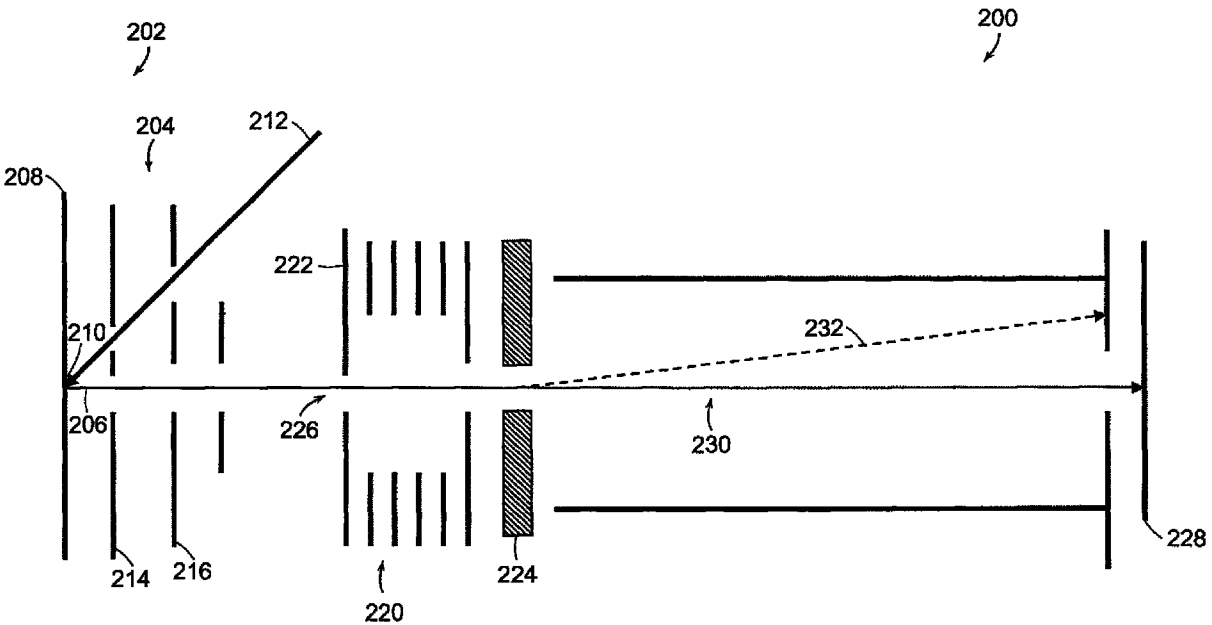
FIG. 3 shows a schematic diagram of a linear TOF mass spectrometer according to the present teaching that includes an ion source with a static ion accelerator.

FIG. 3 shows a schematic diagram of a linear TOF mass spectrometer 200 according to the present teaching that includes an ion source 202 with a static ion accelerator 204. The ion source 202 generates a pulse of ions 206. The ion source 202 includes a sample plate 208 that positions a sample 210 for analysis. An energy source, such as a laser, is positioned to provide a beam of energy 212 to the sample 210 positioned on the sample plate 208 that ionizes sample material. The beam of energy 212 can be a pulsed beam of energy, such as a pulsed beam of light.

The static ion accelerator 204 includes a first 214 and second electrode 216 positioned adjacent to the sample plate 208. An ion flight path 226 is positioned adjacent to static ion accelerator 204. An ion detector 228 is positioned at the end of ion fight path 226. A pulsed ion accelerator 220 is positioned in the ion flight path 226 between the electrode 216 and the ion detector 228. In some embodiments, ion focusing and steering elements (not shown) are positioned in the ion flight path 226 between the electrode 216 and the pulsed ion accelerator 220. The pulsed ion accelerator 220 includes an entrance plate 222. A timed ion selector 224 is positioned adjacent to the pulsed ion accelerator 220. A field-free ion drift space 230 is positioned adjacent to the timed ion selector 224. The ion detector 228 is positioned at the end of the field-free ion drift space 230.

In operation, a beam of energy 212, which can be a pulsed beam of energy, is generated and directed to the sample 210. The beam of energy 212 can be a pulsed laser beam that produces ions from samples present in the gas phase. An energetic pulse of ions can also be produced by secondary ionization mass spectrometry (SIMS). In some methods of operation, the sample 210 includes a UV absorbing matrix and ions are produced by matrix assisted laser desorption ionization (MALDI).

The static ion accelerator 204 is biased with a DC voltage to accelerate the pulse of ions into the pulsed ion accelerator 220. The pulsed ion accelerator 220 accelerates the pulse of ions. The timed ion selector 224 transmits ions accelerated by the pulsed ion accelerator 220 into the field-free drift space 230 and rejects other ions by directing the ions along trajectory 232. The accelerated ions transmitted by the timed ion selector 224 are then detected by ion detector 228.

Figure 4:
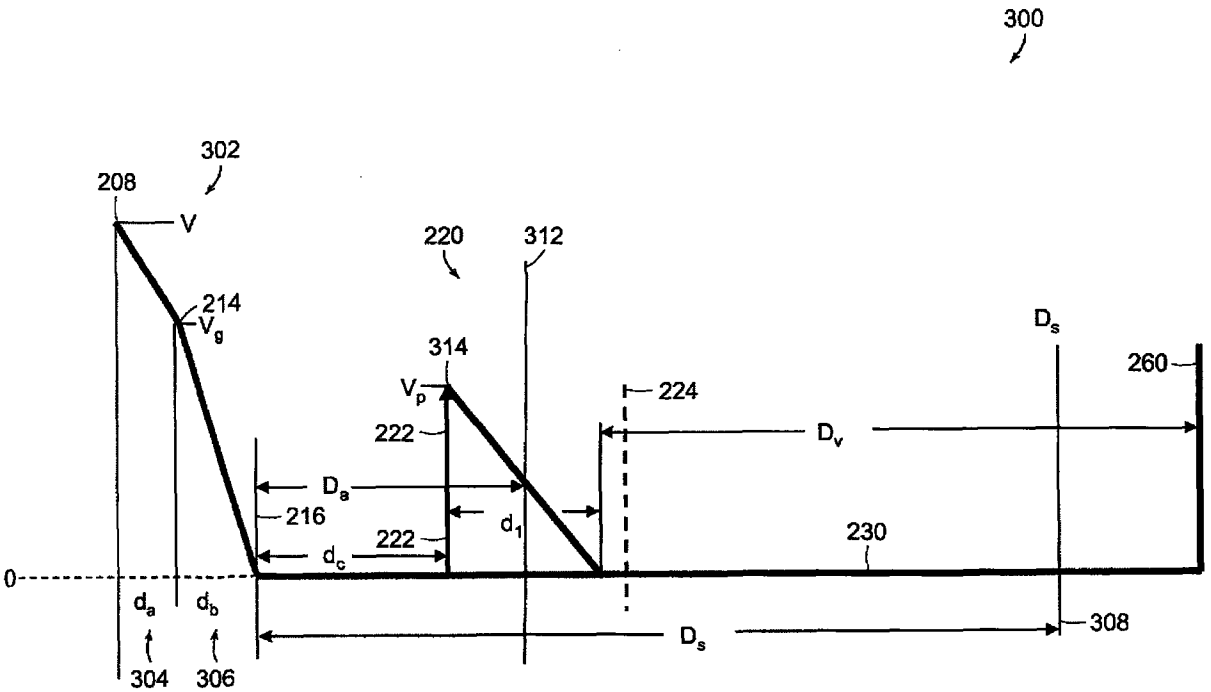
FIG. 4 shows a potential diagram for the linear TOF mass spectrometer according to the present teaching that was described in connection with FIG. 3.

FIG. 4 shows a potential diagram 300 for the linear TOF mass spectrometer 200 according to the present teaching that was described in connection with FIG. 3. Referring to both the linear TOF mass spectrometer 200 shown in FIG. 3 and to the potential diagram 300 shown in FIG. 4, the potential diagram 300 includes a static two-field ion acceleration region 302. A static voltage V is applied to the sample plate 208. A static voltage $V_g$ is applied to the first electrode 214 which is positioned a distance $d_a$ 304 away from the sample plate 208. The second electrode 216, which is positioned a distance $d_b$ 306 away from the first electrode 214, is at ground potential. The static voltages V and $V_g$ focus the ions generated at the sample plate 208 in time at a point $D_s$ 308 in field-free drift space 230. At distance $D_s$ 308, the flight time of any mass is independent (to first order) of the initial position of the ions produced from ion sample plate 208.

At the time that an ion of predetermined mass-to-charge ratio reaches a predetermined point 312 in the pulsed accelerator 220, a pulsed voltage $V_p$ 314 is applied to the entrance plate 222 of the pulsed ion accelerator 220 which focuses the ions through the second field-free drift space 230 to the detector 228 thereby removing (to first order) the effect of both initial position and initial velocity of the ions on the flight time from the pulsed accelerator 220 to the detector 228. The timed ion selector 224 located adjacent to the exit of the pulsed accelerator 220 is activated to transmit only ions accelerated by pulsed accelerator 220 and to prevent all other ions from reaching the detector 228.

Figure 5:
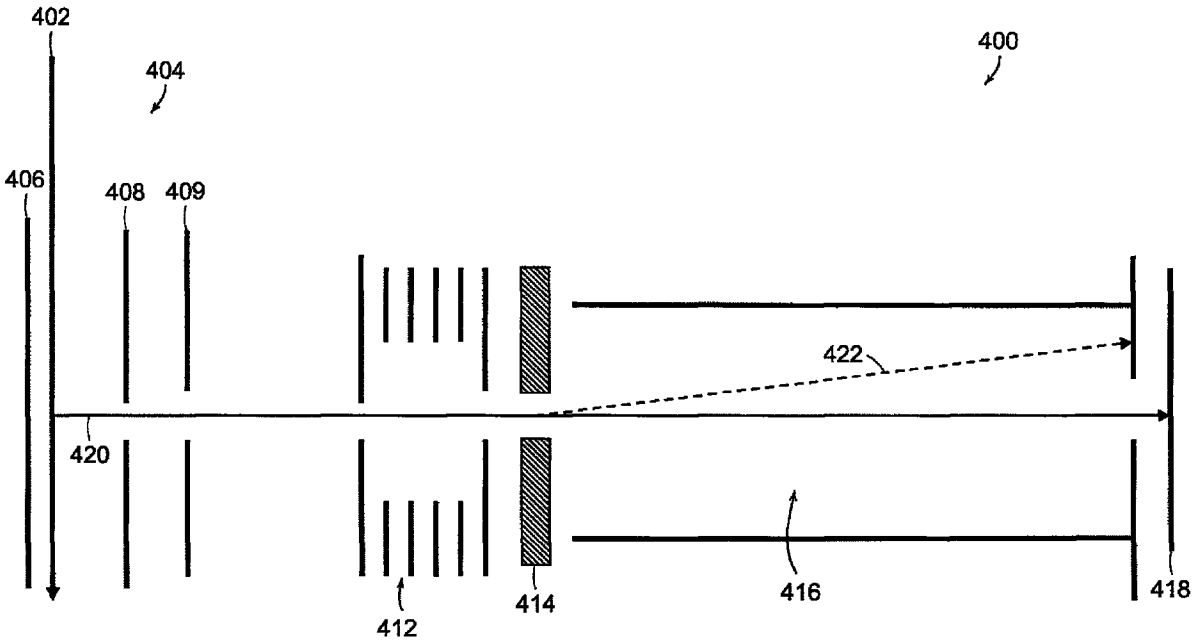
FIG. 5 shows a schematic diagram of a linear TOF mass spectrometer according to the present teaching that includes a continuous ion source with a pulsed ion accelerator.

FIG. 5 shows a schematic diagram of a linear TOF mass spectrometer 400 according to the present teaching that includes a continuous ion source 402 with a first pulsed ion accelerator 404. The linear TOF mass spectrometer 400 is similar to the linear TOF mass spectrometer 200 that was described in connection with FIG. 3. However, the linear TOF mass spectrometer 400 includes the continuous ion source 402. Numerous types of ions sources can be used. For example, the continuous ion source 402 can be an external ion source wherein the beam of ions is injected orthogonal to the axis of the ion flight path. In some embodiments, the external ion source is an electrospray ion source. In other embodiments, the continuous ion source 402 is an electron beam that produces ions from molecules in the gas phase.

The first pulsed ion accelerator 404 includes a first 406 and a second electrode 408 that are positioned adjacent to the continuous ion source 402. A third electrode 409 is at grounded potential. A second pulsed ion accelerator 412 is positioned adjacent to third electrode 409. A timed ion selector 414 is positioned adjacent to the second pulsed ion accelerator 412. A field-free ion drift space 416 is positioned adjacent to the timed ion selector 414. An ion detector 418 is positioned at the end of the field-free ion drift space 416. The potential diagram for the linear TOF mass spectrometer 400 according to the present teaching is similar to the potential diagram of the linear TOF mass spectrometer that includes the ion source with the static ion accelerator shown in FIG. 4.

In operation, a continuous stream of ions 420 is generated by the continuous ion source 402. The continuous stream of ions 420 is injected into the first pulsed ion accelerator 404. A voltage pulse is periodically applied between the first 406 and the second electrode 408 to generate an electric field which accelerates a portion of the continuous stream of ions 420 in the form of a pulse of ions. The pulse of ions is further accelerated by a static electrical field that is established between the second electrode 408 and the electrode 409 that is at ground potential. The pulse of ions propagates to the second pulsed ion accelerator 412 where the pulse of ions is accelerated by a second pulsed electrical field generated by the second pulsed ion accelerator 412. The timed ion selector 414 transmits ions accelerated by the second pulsed ion accelerator 412 and rejects other ions by directing the ions along trajectory 422. The accelerated ions transmitted by the timed ion selector 414 are then detected by ion detector 418.

In some embodiments, the accelerating electric fields are static during ion acceleration. The accelerating electric fields are generated by constant DC voltages. In some linear TOF mass spectrometers, a pulse of ions is produced by the interaction of a pulse of energy with the sample deposited on a solid surface. Examples of such ionization are laser desorption or secondary ion mass spectrometry (SIMS). Other linear TOF mass spectrometers use gas phase ionization. Examples of such ionization are electron ionization (EI) or electrospray. In the linear TOF mass spectrometers according to the present teaching, a portion of the accelerating field may be pulsed. However, time lag focusing is not employed.

To illustrate the present teaching, an analysis of a two-field ion accelerator for a linear TOF mass spectrometer is presented to show that both spatial and velocity focusing can be achieved simultaneously. The parameters employed in this analysis are shown in FIG. 4. The space focusing distance for a two-field ion accelerator is given by $$D_s=2d_a y^{3/2}[1-(d_b/d_a)/(y+y^{1/2})]$$

where $d_a$ is the length of the first accelerating field, $d_b$ is the length of the second accelerating field and y is the ratio of the total accelerating potential V to the accelerating potential in the first field $V-V_g$, where $V_g$ is the potential applied the electrode intermediate to the two fields. The total effective length of the source is given by $$D_{es}=2d_a y^{1/2}[1+(d_a/d_b)/(y^{1/2}+1)]$$

The time dispersion at the source exit due to the initial velocity of the ions is given by $$\delta t_v=(2d_a y/v_n)(\delta v_0/v_n),$$

where $\delta v_0$ is the initial velocity spread of the ions and $v_n$ is the nominal ion velocity after acceleration.

The corresponding time dispersion at the source exit due to the initial position of the ions is given by $$\delta t_s=(2d_a y/v_n)(\delta x/2d_a y)=(\delta x/v_n),$$

where $\delta x$ is the spread in initial position of the ions.

The first order dependence of the flight time on the initial velocity and the initial position to a point a distance D in a field-free ion flight path adjacent to the ions source is given $$t=(D_e/v_n)[1+(D/D_e)f_1 p-(2d_a/D_e(v_0/v_n)],$$

where $$f_1=\{y^{-1}-(2d_a/D)y^{1/2}+(2d_b/D)(y^{1/2}+1)^{-1}\}$$

The dependence on the perturbation p for a given geometry is eliminated by adjusting the voltage ratio $y=V/(V-V_g)$ so that $f_1=0$.

In prior art systems, the acceleration delay is adjusted to eliminate the dependence on the initial velocity $v_0$ to achieve time lag focusing. The nominal final velocity $v_n$ of the ion of mass-to-charge ratio m/z is given by $$v_n=C_1(zV/m)^{1/2}$$

where m is the ion mass, z is the charge, and V is the accelerating voltage. The perturbation due to the spread in the initial position is $$p_2=(\delta x/2d_a y),$$

where $\delta x$ is the spread in initial position.

Velocity focusing can also be achieved with the linear TOF mass spectrometer including the two-field ion accelerator and a separate pulsed ion accelerator according to the present teaching. To achieve velocity focusing, a pulse having an amplitude $V_p$ is applied to a separate pulsed ion accelerator. The first order dependence of the flight time on the initial velocity is eliminated at a distance $D_v$ from the exit of the pulsed ion accelerator.

The kinetic energy of an ion with initial velocity $v_0$ assuming that the pulsed ion accelerator is activated at the time when an ion with zero initial velocity reaches the center of the pulsed accelerator is given by $$zV[(1+q_0(1-\delta x/2d_1)]=zV[1+q_0(1-(D_{ea}/d_1)(v_0/v_n)]=zV(1+q_0)\{1-p_1\},$$

where $V_p$ is the amplitude of the pulsed voltage, $d_1$ is the length of the pulsed accelerating field, $D_{ea}=D_{es}+D_a$, where $D_{es}$ is the effective length of the static accelerating field, $D_a$ is the distance from the end of the static field to the center of the pulsed accelerating field, $q_0=V_p/2V$, $p_1=[q_0/(1+q_0)](D_{ea}/d_1)(\delta v_0/v_n)$, and the initial energy is equal to zV.

The time for ions to travel to a point $D_v$ in the field-free region is given by $$t=(v_2-v_1)/a+D_v/v_2,$$

where $a=zV_p/md_1$. The time for ions to travel to a point $D_v$ can then be expressed as $$t32\ (2d/v_n)(V/V_p)[(1+q_0)^{1/2}\{1-p_1\}^{1/2}-1]+(D_v/v_n)\ [(1+q_0)^{-1/2}\{1-p_1\}^{-1/2}]$$

The time for ions to travel to point $D_v$ to first order in initial velocity $v_0$ is then $$t32\ (2d/v_n)(V/V_p)[(1+q_0)^{1/2}\{1-p_1/2\}-1]+(D_v/v_n)\ [(1+q_0)^{-1/2}\{1+p_1/2\}]$$

Thus, the time for ions to travel to point $D_v$ is independent of the perturbation in velocity focus $p_1$ if the following conditions are met:

$$2d(V/V_p)(1+q_0)^{1/2}p_1=D_v(1+q_0)^{-1/2}p_1 \text{ and}$$

$$(D_v/2d)=(1+q_0)(V/V_p)=(V_a+V)/V_p=(V/V_p)[1+q_0]=(1+q_0)/2q_0$$

The time for ions to travel to point $D_v$ as a function of the perturbation in velocity focus $p_1$ can then be expressed as:

$$t=(D_v/v_a)(1+q_0)^{-1/2}[(1-p_1)^{1/2}+(1+p_1)^{-1/2}-(1+q_0)^{-1/2}]$$

The spatial focusing error also contributes to an increase in the mass-to-charge ratio peak width. The kinetic energy of ions with the spatial focusing error is given by $zV(1-p_2)$, where the perturbation in spatial focusing is given by $$p_2=(\delta x/2d_a v).$$

At the space focus point, the ions with higher energy overtake the ions with lower energy. If the space focus is located at a greater distance than the pulsed accelerator, for example, in the vicinity of the detector, then the lower energy ions arrive at the pulsed accelerator before those with higher energy. The later arriving ions with relatively high energy are accelerated by the pulsed ion accelerator more than the ions with relatively low energy, which effectively increases their space focal distance. The kinetic energy of ions after acceleration in the pulsed accelerator is given by $$zV[(1-p_2)+q_0(1-\delta x/d_1)]=zV\{(1-p_2)+q_0[1+(D_a/d_1)p_2]\}=zV(1+q_0)[1-\{1-[q_0/(q_0+1)](D_a/d_1)\}p_2]=zV(1+q_0)(1-p_3),$$

where $zV(1-p_2)$ equals the initial energy and the spread in the initial position is $$\delta x=-D_a p_2,\ p_3=p_2\{1-[q_0/(q_0+1)](D_a/d_1)\}, \text{ and } q_0=V_p/2V.$$

The flight time from the pulsed accelerator to a detector at distance D is given by $$t=(2d_1/v_n)(V/V_p)[\{(1+q_0)^{1/2}[(1-p_3)^{1/2}-(1-p_2)^{1/2}]+(D_v/v_n)(1+q_0)^{-1/2}(1-p_3)^{-1/2}$$

Thus, the total flight time is given by $$t(\text{total})=t_1+t=(D_{ea}/v)+t.$$

Spatial focusing occurs at distance $D_s$ in the absence of ion acceleration.

The total flight time in the absence of ion acceleration is $[D_{es}+D_s]/v$ where $v=v_n(1-p_2)^{1/2}$.

The relative difference in flight time to a point in the drift space is given approximately by $$\delta t/t=[D+d_1/2)/(D+D_{es})]\{(1-p_2)^{-1/2}-(1+q_0)^{-1/2}(1-p_3)^{-1/2}\},$$

where $$p_3=p_2\{1-[q_0/(q_0+1)](D_a/d_1)\}.$$

Then to first order, the relative difference in flight time to a point in the drift space is given by $$\delta t/t=[(D+d_1/2)/(D+D_{es})]\{(1+p_2/2-(1-q_0/2)(1-(p_2/2)[q_0(1-q_0)](D_a/d_1)\} \text{ and}$$

$$\delta t/t=\{q_0/2+(p_2/2)[1-q_0(D_a/d_1)]\}$$

Thus, the change in spatial focal point due to the pulsed accelerator to first order is approximately $$\Delta D/D_v=(q_0/2).$$

It has been discovered that the space focus and the velocity focus can be made to coincide by adjusting the value of y so that $D_s=D_v-\Delta D+d_c+d_1=D_v(1-q_0/2)+d_c+d_1$, where $d_c$ (FIG. 4) is the distance between the grounded electrode 216 and the entrance plate 222 to the pulsed accelerator 220, and $d_1$ is the length of pulsed accelerator 220.

Referring now to FIG. 4, ions of a predetermined mass are focused at the detector 260. To first order, the peak width is zero and is independent of both initial velocity and initial position. The actual peak width at the detector 260 depends on higher order terms in the perturbations, and is approximately equal to $[p_1^2+p_2^2]/4$.

The focus position as a function of mass can be expressed as $$(D_v/2d)=(1+q)(V/V_p).$$

where $q=q_o[1+2(D_{ea}/d_1)(1-m_0/m)^{1/2}\}]$ and $m_0$ is the mass of the ion focused to first order at the detector 260. The relative focusing error as function of mass is then equal to $$\Delta D/D_v=[D_v(m)-D_v(m_0)]/D_v(m_0)=[(1+q)-(1+q_0)]/(1+q_0)=(q-q_0)/(1+q_0).$$

The width of the peak at the detector 260 relative to the flight time is then given to first order by $$\delta t/t=p\Delta D/D=p(q-q_0)/(1+q_0).$$

Since $p_1$ and $p_2$ are independent variables, the total effective perturbation accounting for all of the initial conditions is given by $$p=[p_1^2+p_2^2]^{1/2} \text{ where}$$

$$p_1=[q_0/(1+q_0)[d_a v/d_1](\delta v_0/v_n) \text{ and}$$

$$p_2=[(1+q_0)^{-1}][(\delta x/2d)+\Delta E/V-V_0/V]/y.$$

The total effective perturbation due to the spatial focusing accounts for all of the sources of initial kinetic energy. Spatial focusing essentially occurs when the contribution of $p_2$ is equal to zero since the term $(\delta x/2d)$ is normally much larger than the other terms in the total effective perturbation.

The total effective perturbation due to the initial velocity is mass dependent since it depends on the final velocity of ions accelerated by the static accelerator, and therefore, is proportional to the square root of the ion mass. The final velocity distribution due to the initial ion velocity may be substantially narrowed relative to the velocity of the ions emerging from the static accelerator. The velocity distribution due to the initial position or the initial ion energy is only slightly reduced by the ratio of ion energies before and after the pulsed acceleration.

Higher order terms of the total effective perturbation may limit the resolving power at the first order focus for ions of low kinetic energy and high mass. The second order dependence on the total effective perturbation is given by $p^2/4$. However for most useful measurements, the resolving power is limited by other factors. In particular, the time resolution limit of the measurement is often the limiting parameter in determining the total effective perturbation. This contribution to peak width caused by the time resolution limit is given by the ratio of the bin width of the digitizer acquiring the detector data plus the nominal width of the pulses from the detector for single events to the total ion flight time. The contributions to the peak width are independent. Therefore, the peak width for a practical system is approximately equal to the square root of the sum of squares of the individual contributions.

Initial velocity distributions for ions produced by MALDI have been determined by several research groups. These research groups generally agree that the initial velocities are less than 1,000 m/s and are independent of the ion mass. Also, these research groups generally agree that the initial velocity depends on properties of the matrix and on the laser fluence. However, definitive measurements of the distribution for any particular set of operating conditions are not known. One aspect of the present teaching is that it has been determined that a mean value of about 400 m/s and a similar value for the width of the distribution (FWHM) accounts satisfactorily for observed behavior with 4-hydroxy-α-cyanocinnamic acid matrix. The initial position for ion formation appears to be determined primarily by the size of the matrix crystals. It has also been determined that a value of 10 μm is a satisfactory approximation for many measurements.

Figure 6:
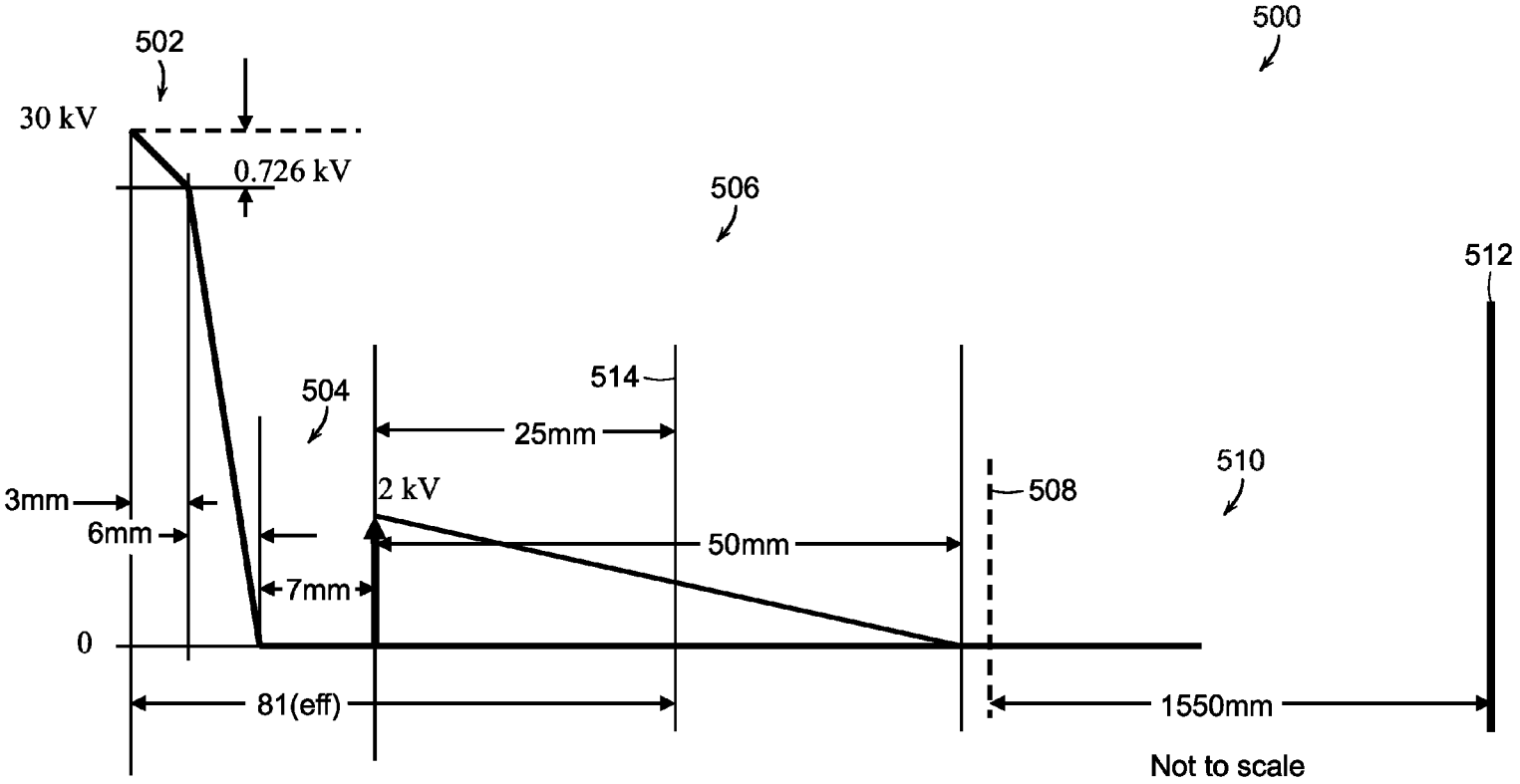
FIG. 6 shows a potential diagram for one embodiment of a linear TOF mass spectrometer that was described in connection with FIG. 3.

FIG. 6 shows a potential diagram 500 for one embodiment of a linear TOF mass spectrometer that was described in connection with FIG. 3. Nominal dimensions in mm are indicated in the figure. The potential diagram 500 shows a two-field ion source region 502 with an initial first electrical field and a second electrical field beginning 3 mm into the ion source region 502 and extending for 6 mm. In the example shown in the potential diagram 500, a 30 kV potential is applied to a static ion accelerator in the two-field ion source region 502, and a 2 kV potential is applied to a pulsed accelerator in the two-field ion source.

A first field-free drift space 504 extends 7 mm from the exit of the two-field ion source region 502. An ion lens can be positioned in the first field-free drift space 504 to focus the ions into a collimated beam. Beam steering electrodes can be positioned in the first field-free region to correct for misalignments and to direct the ion beam toward the detector 512. A pulsed acceleration region 506 extends 50 mm from the first field-free drift space 504. A timed ion selector 508 is positioned at the exit of the pulsed acceleration region 506. A second field-free drift space 510 extends 1550 mm from the timed ion selector 508 to the detector 512.

In operation, the potentials shown in the potential diagram 500 are chosen so that the voltage applied to the intermediate electrode in the static accelerator in the two-field ion source region 502 is adjusted so that the space focus, with modification by the pulsed accelerator in the pulsed acceleration region 506, occurs at the detector 512. For the linear TOF mass spectrometer geometry illustrated in the potential diagram 500, a voltage difference across the first stage of the static accelerator needs to be about 0.726 kV. The pulsed accelerator is activated when the predetermined mass $m_0$ is substantially at the midpoint 514 of the pulsed acceleration region 506, which is about 25 mm into the pulsed acceleration region 506. The spatial focus is substantially independent of the mass of the ions. The velocity focus position is weakly dependent on mass, and errors in the velocity focus may limit the resolving power, particularly at higher mass. Ions of mass $m_0$ are focused, to first order, in both initial velocity and initial position at the detector 512.

The geometry shown in the potential diagram 500 corresponds to a value $q_0$=1/30. The focal length for velocity focusing is given by $$(D_v/2d_1)=(1+q_0)(V/V_p)=15.5.$$

Thus $D_v$=1,550 as shown in FIG. 5. The focal length for space focusing is given by $$D_s=2d_a y^{3/2}[1-(d_b/d_a)/(y^{1/2}+y)]=32+D_v(1-q_0/2)=1556.$$

For values of $d_a$=3 and $d_b$=6, this equation can be solved numerically to give y=41.8 and $V-V_g$=0.726 kV.

The relative focusing error as function of mass is equal to $$\Delta D/D_v=(q-q_0)/(1+q_0),$$

where $q=q_o[1+2(D_{ea}/d_1)(1-(m_0/m)^{1/2}\}]$ and $m_0$ is the mass of the ion focused to first order at the detector 228. For the geometry illustrated in FIG. 5, $$D_{ea}=D_{es}+7+25, \text{ and}$$

$$D_{es}=2d_a y^{1/2}[1+(d_b/d_a)/(1+y^{1/2})]=49; \text{ thus } D_{ea}/d_1=1.62; \text{ then}$$

$$q/q_0=[4.24-3.24(m_0/m)^{1/2} \text{ and the maximum mass focused } (q/q_0=2) \text{ is}$$

$$m_{max}=2.09m_0 \text{ and the minimum mass } (q/q_0=0) \text{ is } m_{min}=0.584m_0.$$

Thus, the total mass range for focusing with this geometry is about a factor of 4. This mass range can be extended by increasing the length $d_1$ of pulsed accelerator 506 relative to the effective distance $D_{ea}$, from source to position 514 which corresponds to the position of mass $m_0$ at the time that the pulsed accelerator 506 is activated.

The mass dependence of the focusing at $D_v$ is given by $$\delta m/m=2(q-q_0)/(1+q_0)\{q_0/(1+q_0)[d_a y/d_1](\delta v_0/v_n)\}=2q_0^2[(q/q_0)-1]/(1+q_0)^2[(d_a y/d_1)(\delta v_0/v_n)$$

$$\delta m/m=[6.28/900]\{[1-(m_0/m)^{1/2}]/(1.068)\}(123.9/50)(0.00525m_0^{1/2})(m/m_0)^{1/2},$$

where $m_0$ is in kDa. Therefore, $$\delta m/m=8.5\times10^{-5}m_0^{1/2}[(m/m_0)^{1/2}-1].$$

The other major contribution to peak width is determined by the time resolution of the measurement. Typically this is limited by the single ion pulse width for the detector and the bin width of the digitizer. In one embodiment, the single ion pulse width for the detector is 0.5 ns and the bin width for the detector is 0.5 ns resulting in a total time uncertainty of 1 ns. The total flight time from the source to the detector is given by the effective distance divided by the velocity. For the geometry depicted in FIG. 5, the effective flight distance is approximately 1650 mm and the velocity for 30 kV ion energy is 0.0761 $m^{-1/2}$ mm/ns. Thus, the contribution to peak width is $$(\delta m/m)_t=2\delta t/t=2m^{-1/2}(1)(0.0761)/1650=9.22\times10^{-5}m^{-1/2}$$

Since the focusing error and the time measurement uncertainty are independent, the peak width is given by the square root of the sum of squares of these individual concentrations.

Figure 7A:
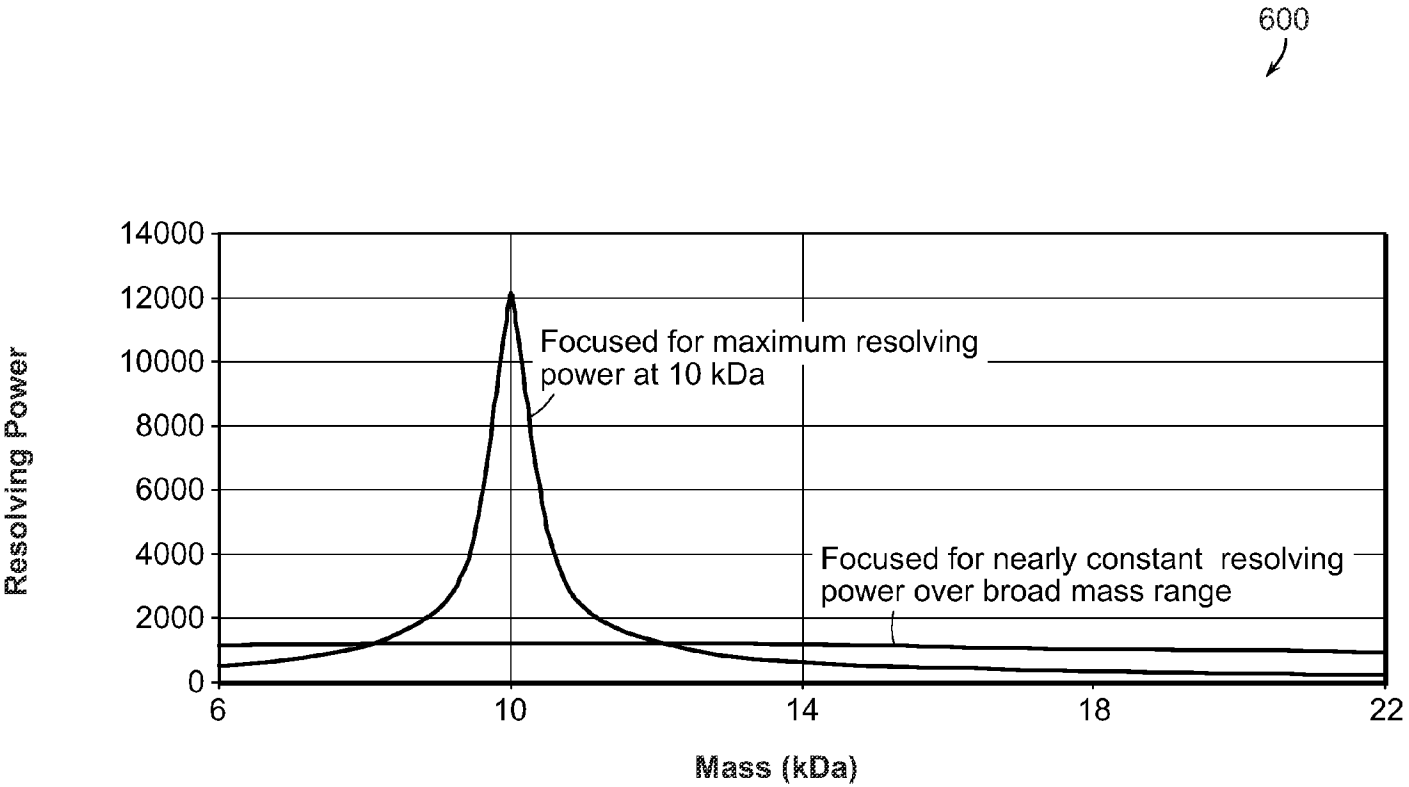
Prior art FIG. 7A
FIG. 7A illustrates a plot of calculated resolving power as function of mass for a prior art TOF mass spectrometer using time lag focusing and MALDI ionization for first order focusing at 10 kDa.
Figure 7B:
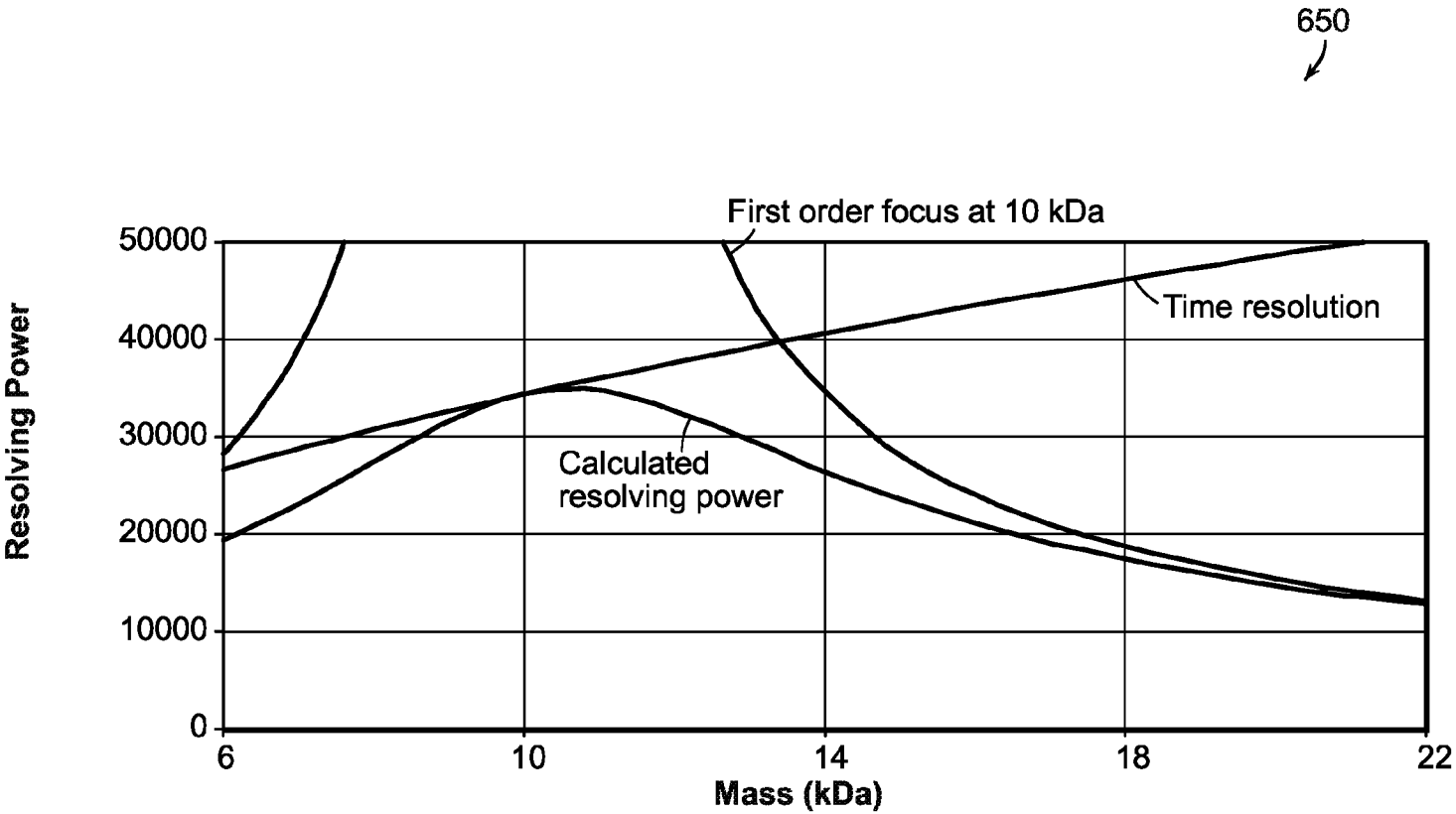
FIG. 7B illustrates a plot of calculated resolving power as function of mass for the embodiment of the TOF mass spectrometer according to the present teaching that is described in connection with FIG. 5 using MALDI ionization for first order focusing at 10 kDa.

FIG. 7A illustrates a plot of calculated resolving power 600 as function of mass for a prior art TOF mass spectrometers using time lag focusing and MALDI ionization for first order focusing at 10 kDa including the uncertainty in the time measurement. FIG. 7B illustrates a plot of calculated resolving power 650 as function of mass for the TOF mass spectrometer 500 described in connection with FIG. 6 using MALDI ionization for first order focusing at 10 kDa. The calculated resolving powers 600, 650 shown in FIGS. 7A and 7B are obtained for a focused mass of 10 kDa accelerated with a voltage of 30 kV. The nominal spread in velocity, $\delta v_0$, used in the calculations illustrated in FIGS. 7A and 7B was assumed to be 400 m/s, the spread in initial position was assumed to be 0.01 mm, and the uncertainty in the time measurement was assumed to be 1 ns.

The data illustrated in FIG. 7A indicates that the calculated resolving power 600 as function of mass for prior art TOF mass spectrometers using time lag focusing can be relatively high. However, the calculated resolving power 600 has a very narrow range about a predetermined mass. Alternatively, the calculated resolving power 600 as function of mass for the prior art TOF mass spectrometers using time lag focusing can be a nearly constant relatively low resolving power over a broad mass range.

FIG. 7B illustrates that the calculated resolving power 650 as function of mass for the linear TOF 200 according to the present teaching provides substantially higher resolving power than is possible using prior art TOF mass spectrometers with time lag focusing. Furthermore, the higher resolving power is achieved over a much wider mass range covering about a factor of four around any predetermined mass.

Substantially identical results can be achieved over any mass range merely by adjusting the accelerating potential in proportion to the focused mass. For example, for a focused mass of 2.5 kDa, the accelerating voltage may be reduced to 7.5 kV to obtain resolving power as function of mass from 1.25 kDa to 5 kDa that is identical to that resolving power shown in FIG. 7B but with the mass scale reduced by a factor of 4.

EQUIVALENTS

While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art, which may be made therein without departing from the spirit and scope of the teaching.

What is claimed is:

1. A time-of-flight mass spectrometer comprising:

a. an ion source that generates ions;

b. a two-field ion accelerator having an input that receives the ions generated by the ion source, the two-field ion accelerator generating an electric field that accelerates the ions generated by the ion source through an ion flight path;

c. a pulsed ion accelerator positioned in the ion flight path adjacent to the two-field ion accelerator, the pulsed ion accelerator generating an accelerating electric field that focuses the ions to a focal plane where the ion flight time to the focal plane for an ion of predetermined mass-to-charge ratio is independent to first order of an initial velocity of the ions prior to acceleration; and d. an ion detector positioned at the focal plane to detect ions, the two-field ion accelerator generating electric fields that cause the ion flight time to the ion detector for an ion of predetermined mass-to-charge ratio to be independent to first order of both the initial position and the initial velocity of the ions prior to acceleration.

2. The mass spectrometer of claim 1 wherein the ion source comprises a pulsed ion source and a first field generated by the two-field ion accelerator comprises a static accelerating electric field.

3. The mass spectrometer of claim 1 wherein the ion source comprises a continuous source and a first field generated by the two-field ion accelerator comprises a pulsed accelerating electric field.

4. The mass spectrometer of claim 3 wherein the ion source comprises an external ionization source.

5. The mass spectrometer of claim 3 wherein the ion source comprises an electrospray ionization source.

6. The mass spectrometer of claim 3 wherein the ion source comprises an electron beam source.

7. The mass spectrometer of claim 1 wherein the sample is positioned on a solid surface.

8. The mass spectrometer of claim 7 wherein the ion source comprises a pulsed laser.

9. The mass spectrometer of claim 7 wherein the ion source comprises a MALDI ion source.

10. The mass spectrometer of claim 1 further comprising a timed ion selector positioned in the ion flight path adjacent to the pulsed ion accelerator, the timed ion selector transmitting ions accelerated by the pulsed ion accelerator and preventing all other ions from passing.

11. The mass spectrometer of claim 1 further comprising an ion lens positioned in the ion flight path between the two-field ion accelerator and the pulsed accelerator, the ion lens spatially focusing the ions to the ion detector.

12. The mass spectrometer of claim 1 further comprising at least one ion steering electrode positioned in the ion flight path between the two-field ion accelerator and the pulsed accelerator that directs the ions to the ion detector.

13. A method for generating high resolution mass spectra by time-of-flight mass spectrometry, the method comprising:

a. generating a pulse of ions from a sample;

b. accelerating the pulse of ions with a first and second electric field;

c. further accelerating the pulse of ions accelerated by the first and second electric fields with a pulsed electric field that focuses ions to a focal plane where an ion flight time to the focal plane for an ion of predetermined mass-to-charge ratio is independent to first order of an initial velocity of the ions prior to acceleration;

d. adjusting the first and second electric fields to cause the ion flight time to the focal plane for ions of the predetermined mass-to-charge ratio to be independent to first order of both an initial position and an initial velocity of the ions prior to acceleration; and e. detecting ions at the focal plane.

14. The method of claim 13 wherein the sample comprises a MALDI sample.

15. The method of claim 13 wherein the generating the pulse of ions comprises irradiating the sample with a pulsed laser.

16. The method of claim 13 further comprising selecting ions from the pulse of ions after the accelerating the pulse of ions with the pulsed electric field and passing only selected ions.

17. The method of claim 13 further comprising spatially focusing ions in the ion flight path after acceleration by the first and the second electric fields to the focal plane.

18. The method of claim 13 further comprising energizing steering ions in the ion flight path after acceleration by the first and the second electric fields.

19. The method of claim 13 wherein the generating the pulse of ions comprises generating the pulse of ions with a pulsed ion source and wherein the first electric field comprises a static electric field.

20. The method of claim 13 wherein the generating the pulse of ions comprises generating the pulse of ions with a continuous ion source and wherein the first electric field comprises a pulsed accelerating electric field.

* * * * *